US009764586B2

(12) United States Patent
Pankow et al.

(10) Patent No.: US 9,764,586 B2
(45) Date of Patent: Sep. 19, 2017

(54) THREE-RING EASEL BINDER WITH EXTENSION SUPPORTS

(71) Applicants: Brian T. Pankow, Midland, MI (US); Carolyn R. Pankow, Midland, MI (US); Catherine H. Pankow, Midland, MI (US); Bradley T. Pankow, Midland, MI (US)

(72) Inventors: Brian T. Pankow, Midland, MI (US); Carolyn R. Pankow, Midland, MI (US); Catherine H. Pankow, Midland, MI (US); Bradley T. Pankow, Midland, MI (US)

( * ) Notice: Subject to any disclaimer, the term of this patent is extended or adjusted under 35 U.S.C. 154(b) by 0 days.

(21) Appl. No.: 15/289,093

(22) Filed: Oct. 7, 2016

(65) Prior Publication Data

US 2017/0028768 A1 Feb. 2, 2017

Related U.S. Application Data

(63) Continuation of application No. 14/578,584, filed on Dec. 22, 2014, now abandoned.

(60) Provisional application No. 61/919,546, filed on Dec. 20, 2013.

(51) Int. Cl.

| | |
|---|---|
| ***B42F 13/02*** | (2006.01) |
| ***B42F 13/40*** | (2006.01) |
| ***B42F 9/00*** | (2006.01) |
| ***B42D 15/00*** | (2006.01) |

(52) U.S. Cl.

CPC ..... *B42F 13/402* (2013.01); *B42D 15/008* (2013.01); *B42F 9/001* (2013.01); *B42F 9/005* (2013.01); *B42F 13/02* (2013.01); *B42F 13/40* (2013.01)

(58) Field of Classification Search

CPC ..... B42F 13/402; B42F 13/02; B42F 9/001

USPC ..... 281/33, 43, 45; 402/70–78, 4; 248/447, 248/452, 444.1

See application file for complete search history.

(56) References Cited

U.S. PATENT DOCUMENTS

| | | | |
|---|---|---|---|
| 372,292 | A | 11/1887 | Becker |
| 1,557,697 | A | 3/1926 | Douglas |
| 1,979,814 | A | 11/1934 | Unger |

(Continued)

FOREIGN PATENT DOCUMENTS

FR 2439679 A1 * 5/1980 ..... B42F 13/402

*Primary Examiner* — Kyle Grabowski

(74) *Attorney, Agent, or Firm* — Michael L. Greenberg, Esq.; Greenberg & Lieberman, LLC

(57) ABSTRACT

A three-ring binder apparatus with extension supports for the secure, hands-free display of up to six pages of material without requiring any other external supports is described. The apparatus facilitates a simple method to turn the pages on an easel or similar freestanding display, and secure them in a desired position. The apparatus is designed as a tool for the display of choreographed workouts, music sheets, and any other situation where multiple pages are needed to be easily accessed. The apparatus consists of a three-ring binder (may be either a freestanding three-ring easel binder or a standard flat three-ring binder), two extension supports, and clipboard-style clips that can be pivoted or folded back into the binder to ease the break-down and transport of the apparatus. The device preferably includes clear pocketed tri-fold sheet protectors or other tri-fold devices.

5 Claims, 2 Drawing Sheets

(56) References Cited

U.S. PATENT DOCUMENTS

| | | | | | |
|---|---|---|---|---|---|
| 2,882,641 | A | * | 4/1959 | Young | A47B 97/02<br>248/448 |
| 3,837,680 | A | | 9/1974 | Cimini | |
| 4,355,821 | A | | 10/1982 | Crawford | |
| 4,552,479 | A | | 11/1985 | Nickow et al. | |
| 5,114,111 | A | | 5/1992 | Andrews | |
| 5,467,958 | A | * | 11/1995 | Selvaggio | A47B 97/04<br>248/452 |
| 5,674,021 | A | | 10/1997 | Hutnick | |
| 6,126,134 | A | | 10/2000 | Adkins | |
| 7,588,268 | B2 | | 9/2009 | Hammet | |
| 7,939,739 | B1 | | 5/2011 | Sadegh et al. | |

* cited by examiner

THREE-RING EASEL BINDER WITH EXTENSION SUPPORTS

This application is a continuation application of patent application Ser. No. 14/578,584, filed on Dec. 22, 2014, which is a non-provisional application of provisional application No. 61/919,546, filed on Dec. 20, 2013, and priority is claimed thereto.

FIELD OF THE PRESENT INVENTION

The present invention relates to a three-ring easel binder with extensions and, more particularly, to a three-ring easel binder with extension supports for display with up to six pages across, providing for a secure and portable hands-free and freestanding display of six pages of printed material without having any other external supports and a simple method to turn the pages and re-secure them into the desired position.

BACKGROUND OF THE PRESENT INVENTION

Current display of material in three-ring binders is generally limited to two pages across. This limits the amount of material that can be displayed. This can be a problem in fitness class plans, choreography, sheet music, chore charts (for parents, nannies, baby sitters), practice problems or drills (for teachers), business presentations, restaurant menus, recipes (for cooks and chefs), product/company literature displays and workplace procedures (for lean manufacturing). In these examples, a lot of information needs to be displayed at once and page turns aren't convenient.

During performances, practices, rehearsals, exercise classes (indoor or outdoor), workers performing a procedure, etc. the reference material is typically spread over more than two pages, requiring the leader or performer to stop what they are doing and turn pages as the performance, activity or class progresses. On-stage or performances in front of a group, this must be done seamlessly. However, unless a page turner is enlisted, the performance or class could experience a pause as a page is turned and the activity restarted. Also, if someone is executing a procedure or recipe, he or she may have to stop what he or she is doing, put down anything in his or her hands, turn the page, and then pick up where he or she left off. As an alternative, to fully display the information, multiple binders or large displays must be used.

In addition, if a stand or table is not available or convenient to the user, especially outdoors, there may be no place to display the pages. If a binder is used, something must be found to prop it up for easy reference.

And, once the performance, display or practice is completed, it may take a while to gather material, collapse the stands and depart.

Another shortcoming is if one is leading a class, stopping the interacting and cuing of participants while turning a page in a binder, which contains their choreographed routine, would be undesirable and might cause the class to lose its place and reduce the effectiveness of the instructor.

As an alternative to this, many fitness instructors or musicians memorize their routines. Experts in many fields tout this as the best way to lead a class or put on a performance. While memorizing a complete performance or class may be easy for some, many people are unable to do this effectively. This discourages them from entering an otherwise enjoyable and satisfying career. In addition, the class leader is working to remember the routine and choreography, and thus cannot focus on what is happening in the class and tailor the intensity of the workout to match the ability of the class. The instructor is less able to shout out words of encouragement to the class, resulting in a less fulfilling experience all around. In addition, memorizing the workouts does not encourage the routine to be varied much from class to class or even from month to month. Pages are often taped together onto a wall or mirror while the performer memorizes the routines. Often if they cannot memorize them, they may require assistance during the actual performance.

The exercise or dance instructors that rely on memorization to lead their class will invariably forget portions or lose their place, causing disruption in the class. And if one has trouble memorizing a routine but does take the time to memorize their class routine, they are then discouraged from varying the routine, which causes them to lose clients who would prefer a little variety. A further issue occurs when the instructor cannot afford the time to memorize, so he or she is discouraged from embarking on this or quitting once he tries to do it.

For dance routines, notes may be taped to the mirror during practice or performance. For exercise classes instructors may resort to taping multiple pages to the mirror in front of them, forcing them to arrive early to set up. In addition, this practice will often leave shreds of tape stuck all over the mirror, causing an unsightly mess.

For business presentations, several binders or even poster board must be used to display more than two pages, which makes breakdown more time consuming and complex.

For a musical performance, a page turner may be hired to turn the pages for the performer.

Background research discovery provides some background patent art in which attempts have been made to display several sheets at once, or employ an automatic page turner.

This can be seen in U.S. Pat. No. 7,588,268 (Issued Sep. 15, 2009), for a sheet music holder that consists of two large clipboards, each holding three sheets across which are hinged together in the middle for easy folding of the holder, and are secured on the ends to keep the boards at a 90 degree angle to one another. The holder is then designed to sit on a raised surface for viewing and reference. Though the holder can display six sheets at once, it is large and cumbersome, which even when collapsed is still three sheets wide. At most it can display six sheets, and then must be resupplied in a time consuming manner to display another six pages, unlike the present invention.

In U.S. Pat. No. 5,114,111 (issued May 19, 1992), the device is a hinged and collapsible music stand designed to hold four pages across and sit upon a stanchion, as current rigid music stands. It is similar to current music stands, with the exception that it is hinged to be collapsible. The stand can not only display four sheets at once but is also large and cumbersome, which even when collapsed is still two sheets wide. In addition, the device does not hold the sheets securely for easy transport.

In U.S. Pat. No. 5,674,021 (issued Oct. 7, 1997) the device is a cardboard binder consisting of a vertical brad-held spine which displays two sheets at once, and a device to bind the pages from above in a horizontal fashion. The intended use is for displaying three sheets at once for courtroom or exhibition use. It does not lend itself very well to easily view more than three pages from a distance where one is not holding the binder. In addition, it is not freestanding.

In U.S. Pat. No. 3,722,922 (issued Mar. 27, 1973) the device is a folding poster board roughly two sheets wide on which forms are attached on the left edge, designed to hold accounting forms. The device can display up to two sheets wide, but is strictly for the supporting pages two sheets wide for writing and is not freestanding, unlike the present invention.

In U.S. Pat. No. 3,837,680 (issued Sep. 24, 1974) the device is a binder that consists of two three-ring binder units which are attached at the back and can slide opposite one another to display four sheets across. It however only displays four sheets and is not freestanding, unlike the present invention.

In U.S. Pat. No. 4,552,479 (issued Nov. 12, 1985) the device is a freestanding easel binder but can display only two pages at a time, unlike the present invention, which can hold over five pages.

In U.S. Pat. No. 4,355,821 (issued Oct. 26, 1982) the device is also a freestanding easel binder but can only display only two pages at a time, rather than the at least 5 pages of the present invention.

In U.S. Pat. No. 1,979,814 (issued Nov. 6, 1934) the device is a freestanding binder designed to display several pages at once. The hinge is along the top, as are the binding rings, which can display as many pages across as is possible by the width of the device. As shown in the patent, the device is three pages wide, but the pages are staggered so that as one sheet is completed, it must be turned over the top to reveal the next. This device is neither very portable nor can it easily display more than three pages at once, unlike the present invention.

In U.S. Pat. No. 1,557,697 (issued Mar. 23, 1926) the device is a freestanding binder designed to display several pages at once. The hinge is along the top, as are the binding rings, which can display only two pages at once, unlike the present invention.

In U.S. Pat. No. 6,126,134 (issued Oct. 3, 2000) the device is a collapsible sheet support that is freestanding. Though highly portable, it can only display two sheets at once, and the sheets must be removed for transport, unlike the present invention.

In U.S. Pat. No. 7,939,739 (issued May 10, 2011) the device is a mechanical page turner, which though may be the answer for some of the problems described above, does not allow for six pages to be scanned at once, unlike the present invention.

It is therefore an object of the present invention to display and manipulate multiple pages of printed material in a binder for ease of reading and referring to the material contained on multiple sheets without having to turn the page, especially where there is no stand on which to put the binder.

It is another object of the invention to easily turn pages and refer to a new set of pages. When a page is required to be turned, it is a simple task of releasing the page holder, pulling the page across and re-securing the page holder on the other side, revealing the back of one set of three pages, and the front of a new set of pages.

It is another object of the invention to display two sets of multiple sheets at once. For example each set of three sheets can be held together by a three sheet wide sheet protector, or other device securing the three sheets together.

It is another object of the invention to allow for a quick and easy way to break down and transport of multiple pages at once.

Thus, there exists a need for a binder-apparatus capable of displaying at least six pages simultaneously, while remaining easy to replace each of the pages in an expedient fashion during use.

SUMMARY OF THE INVENTION

In accordance with the present invention, there is provided a Three-ring Binder with Extension Supports for a secure hands-free display of up to six pages of printed material without having any other external supports and a simple method to turn the pages to display up to six more pages, and re-secure them. The binder preferably consists of a three-ring binder, which may be a freestanding easel binder. On the inside of each of the facing binder covers, preferably two extension supports swing out from the covers of the three-ring binder, expanding the display space available via the binder. These extension supports may be constructed of wood, plastic, or any other suitable semi-rigid or rigid material. These extension supports each contain a securing device near the end, such as a clipboard-style clip, for securely holding the pages out away from the rings, and are secured to the three-ring binder with hinge or rotatable mounting hinge. The material may be contained in a tri-fold sheet protector which allows up to three pages to be displayed at once on either side of the rings. The tri-fold sheet protectors are unfolded from the rings and secured to the extension supports.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT OF THE PRESENT INVENTION

Figure 1:
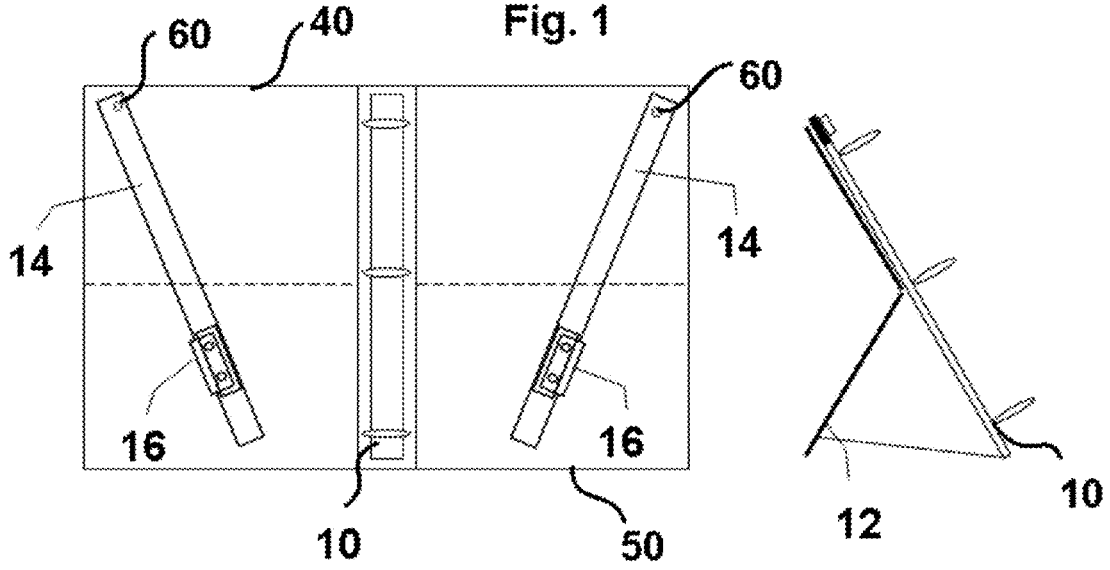
FIG. 1 is a front and side view of the present invention, showing a simple front view with extension supports folded and side view as an easel binder with the extension supports extended.

The present invention relates to the display and manipulation of multiple pages of printed material in a three-ring binder (10) for ease of reading and referring to the material contained on up to six pages without having to turn the page, especially where there is no stand on which to put the binder. The present invention is equipped with a display (20), a clipboard-style clip (16), an extension support (14), an easel support (12), and a tri-fold sheet protector (18). When a page is required to be turned, it is a simple task of releasing the material to display (20) from under the clipboard-style clip (16) supported by the extension support (14), pulling the page across and re-securing the material to display (20) on the other side under the clipboard-style clip (16) on the extension support (14), revealing the back of one set of three, and the front of a new set. The set of three sheets is preferably held together by a tri-fold sheet protector (18), or other similar device securing the three sheets together. This is particularly useful when multiple sheets must be referred to, but the user of the material cannot easily turn the pages each time a sheet is no longer needed in order to access the next sheet.

The base of the present invention consists of a three-ring binder (10). The three-ring binder (10) is equipped with a first cover (40) and a second cover (50) similar to those found on conventional binders. The three-ring binder (10) may be an easel binder as shown in FIG. 1. If an easel binder is used, the binder would be freestanding, being supported by the easel support (12). Otherwise, it would have to be externally supported, as on a music stand. An extension support (14) is attached to the first cover (40) and an extension support (14) is attached to the second cover (50) of the three-ring binder (10) via a pivot point attachment (60) or hinge. In FIG. 1, the extension support (14) is shown in a folded position. A clipboard-style clip (16) is shown attached to each extension support (14). Some embodiments of the present invention need not employ an easel support, and are instead equipped with a planar support configured to pivot out and away from the center of the three-ring binder (10), maintaining the three-ring binder (10) in an upright, eyelevel position when disposed atop a flat surface, such as a table.

Figure 2:
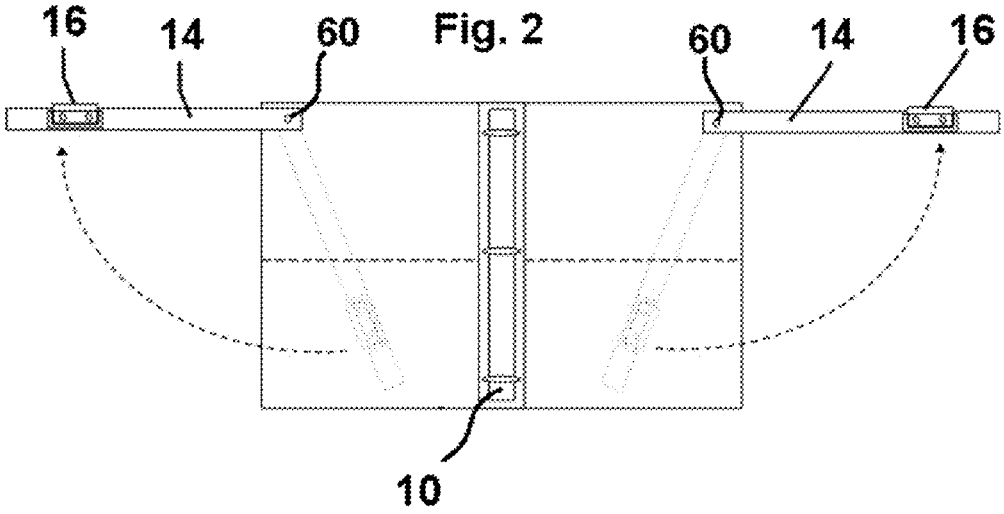
FIG. 2 is a front view of the binder with extensions supports extended, showing a general layout with no pocket inserts or pages shown.

In FIG. 2, each extension support (14) is shown in the extended position, having been pivoted on a pivot point attachment (60). The extension support (14) may be constructed of wood, plastic, acrylic, metallic alloy, or any other suitable semi-rigid or rigid material. Again, a clipboard-style clip (16) is shown attached to an extension support (14). For ease of understanding, each extension support (14) is shown in the folded position as faint lines in FIG. 2. The fact that the extension support (14) can be folded back is important in that this allows for portability of the device, which when folded is as large as a normal, conventional three-ring binder.

Figure 3:
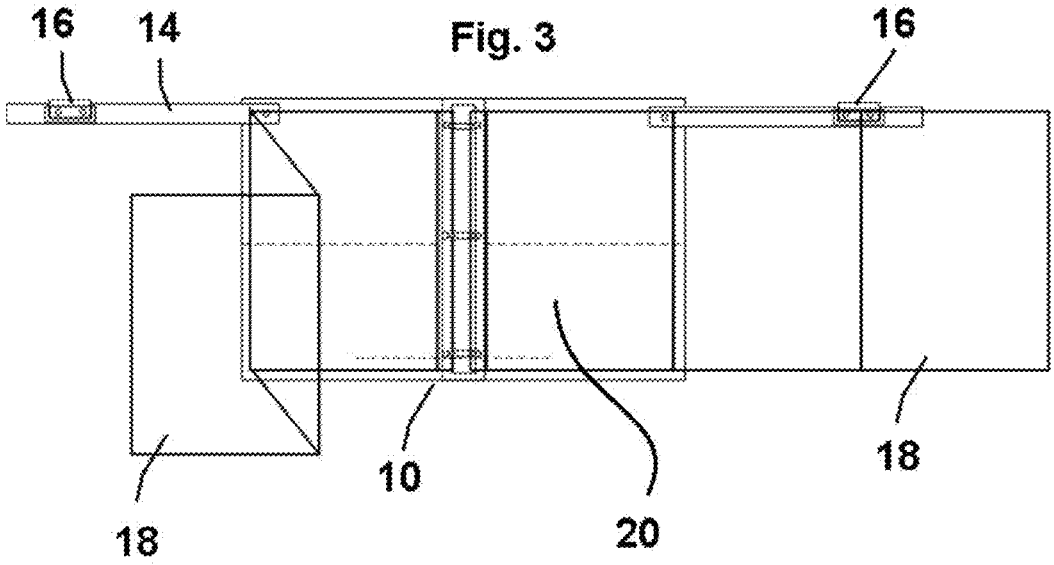
FIG. 3 exhibits a front view of the present invention with extensions extended and the transparent trifold sheet protectors shown.

In FIG. 3, each extension support (14) is shown in the extended position and the transparent tri-fold sheet protector (18) is shown inserted into the three-ring binder (10). The tri-fold sheet protector (18) is shown here for ease of understanding. Any sheet which is greater than 17" wide may be used. If a tri-fold sheet protector (18) is used, the sheets will easily fold back into the binder when moved. If a wider sheet is used, it must be folded to get set back into the binder prior to each extension support (14) pivoting back into the three-ring binder (10) for transport via the pivot point attachments (60).

Figure 4:
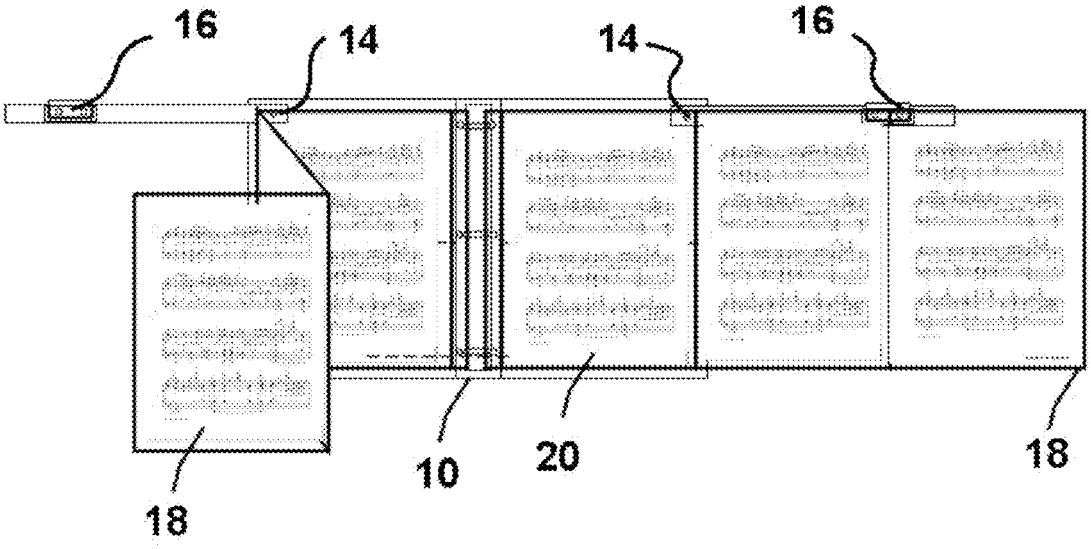
FIG. 4 displays a front view of the general layout of the present invention with inserts shown in the tri-fold sheet protectors of the present invention.

In FIG. 4, note that material to place on display (20) has been inserted in the tri-fold sheet protector (18). It is otherwise the same as FIG. 3.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

We claim:

1. A method for displaying six pages of paper on the same plane at eyelevel of a user comprising:

affixing an easel support to a rear of a three-ring binder;

extending the easel support to the floor;

orienting the easel support such that it is at eyelevel of the user;

opening the three-ring binder, revealing a first extension support disposed on a right side of the three-ring binder, a second extension support disposed on a left side of the three-ring binder, a first clip-board styled clip disposed on the first extension support, a second clip-board styled clip disposed on the second extension support, and three-rings disposed at a center spine of the three-ring binder;

pivoting the first extension support from the right side of the three-ring binder out and away from the center spine of the three-ring binder;

pivoting the second extension support from the left side of the three-ring binder out and away from the center spine of the three-ring binder;

placing the pages of paper into tri-fold sheet protectors;

affixing the tri-fold sheet protectors to the three-rings of the three-ring binder;

unfolding a first tri-fold sheet protector to the right of the three-rings such that all three page display panes of the first tri-fold sheet protector is laid out in the same plane;

affixing the first tri-fold sheet protector to the first extension support via the first clip-board styled clip, maintaining the first tri-fold sheet protector in the extended position;

unfolding a second tri-fold sheet protector to the left of the three-rings such that all three page display panes of the second tri-fold sheet protector are laid out in the same plane;

affixing the first tri-fold sheet protector to the second extension support via the second clip-board styled clip, maintaining the second tri-fold sheet protector in the extended position;

wherein said easel support is configured to support said three-ring binder at an angle, distributing the weight of said three-ring binder, said first extension support, and said second extension support evenly, maintaining the easel binder in an upright, viewable position; and wherein the easel support is in communication with the three-ring binder via a pivot hinge.

2. A method for the erection and portable use of a six-page display stand comprising:

opening a three-ring binder;

extending a stand from a rear of the three-ring binder by pivoting an easel support out and away from said three-ring binder via a pivot point disposed at a center of the three-ring binder;

extending a first extension support by pivoting the first extension support about a first pivot point attachment until it is parallel and inline with a top of the three-ring binder, the first pivot point attachment disposed at a top right corner of a right side of the three-ring binder;

extending a second extension support by pivoting the second extension support about a second pivot point attachment until it is parallel and inline with the top of the three-ring binder, the second pivot point attachment disposed at a top left corner of a left side of the three-ring binder;

opening the three rings of the three-ring binder;

affixing sheet protectors to the three-rings of the three-ring binder, the sheet protectors configured with three sections each, each section configured to house one of three pages, the three sections disposed atop one another;

closing the three rings of the three-ring binder;

resting the sheet protectors on the right side of the three-ring binder;

unfolding the sheet protectors, causing all three pages contained within each sheet protector to be disposed upright and inline with the three-ring binder in the open position;

turning a sheet protector from the right side of the three-ring binder over to the left side of the three-ring binder about the three rings of the three-ring binder;

affixing the sheet protector of the left side of the three ring binder to the second extension support via a first clipboard-style clip;

affixing the sheet protectors disposed on the right side of the three-ring binder to the first extension support via a second clipboard-style clip; and viewing six pages simultaneously.

3. The method of claim 2, further comprising:

unclipping the second clipboard-style clip to release one sheet protector, turning a sheet protector from the right side to the left side about the three rings of the three-ring binder;

clipping the sheet protector in position on the left side via the first clipboard-style clip; and viewing six more pages simultaneously.

4. The method of claim 3, further comprising:

folding the sheet protectors such that each of the three sections of each sheet protector are in the same plane;

retracting the first extension support and the second extension support such that they are fully contained within the three-ring binder;

retracting the stand such that it is on the same plane as the right side and left side of the three-ring binder; and closing the three-ring binder.

5. A method for displaying six pages of paper on the same plane at eyelevel of a user comprising:

opening a three-ring binder, revealing a first extension support disposed on a right side of the three-ring binder, a second extension support disposed on a left side of the three-ring binder, a first clip-board styled clip disposed on the first extension support, a second clip-board styled clip disposed on the second extension support, and three-rings disposed at a center spine of the three-ring binder;

pivoting out a planar support from a rear of the three-ring binder such that it extends out and away from a center of the three-ring binder;

orienting the three-ring binder such that it is at eyelevel of the user, supported atop a flat surface;

pivoting the first extension support from the right side of the three-ring binder out and away from the center spine of the three-ring binder;

pivoting the second extension support from the left side of the three-ring binder out and away from the center spine of the three-ring binder;

placing the pages of paper into tri-fold sheet protectors;

affixing the tri-fold sheet protectors to the three-rings of the three-ring binder;

unfolding a first tri-fold sheet protector to the right of the three-rings such that all three page display panes of the first tri-fold sheet protector is laid out in the same plane;

affixing the first tri-fold sheet protector to the first extension support via the first clip-board styled clip, maintaining the first tri-fold sheet protector in the extended position;

unfolding a second tri-fold sheet protector to the left of the three-rings such that all three page display panes of the second tri-fold sheet protector are laid out in the same plane;

affixing the first tri-fold sheet protector to the second extension support via the second clip-board styled clip, maintaining the second tri-fold sheet protector in the extended position; and, wherein said planar support is configured to support said three-ring binder at an angle, distributing the weight of said three-ring binder, said first extension support, and said second extension support evenly, maintaining the easel binder in an upright, viewable position.

* * * * *